United States Patent [19]

Boop

[11] 4,234,768

[45] Nov. 18, 1980

[54] SELECTIVE FIRE PERFORATING GUN SWITCH

[75] Inventor: Gene T. Boop, Ft. Worth, Tex.

[73] Assignee: Sie, Inc., Ft. Worth, Tex.

[21] Appl. No.: 899,705

[22] Filed: Apr. 24, 1978

Related U.S. Application Data

[60] Continuation-in-part of Ser. No. 745,686, Nov. 29, 1976, Pat. No. 4,100,978, which is a division of Ser. No. 535,355, Dec. 23, 1974, Pat. No. 4,007,796.

[51] Int. Cl.[3] ..... H01H 9/00; H01H 15/00

[52] U.S. Cl. ..... 200/52 R; 200/16 C; 200/82 R

[58] Field of Search ..... 200/16 C, 16 D, 52 R, 200/61.04, 61.07, 61.47, 61.93, 81.9 R, 82 R, 83 J, 83 N

[56] References Cited

U.S. PATENT DOCUMENTS

| | | | |
|---|---|---|---|
| 2,671,893 | 3/1954 | Van Scoy et al. | 200/83 N X |
| 2,837,609 | 6/1958 | Clayton et al. | 200/16 C |
| 3,309,474 | 3/1967 | Heinrich | 200/61.07 |
| 3,363,715 | 1/1968 | Langdon | 200/82 R X |
| 3,855,708 | 12/1974 | Tann et al. | 200/16 D X |
| 3,912,893 | 10/1975 | Stoler | 200/61.93 |

*Primary Examiner*—James R. Scott

*Attorney, Agent, or Firm*—G. Turner Moller

[57] ABSTRACT

A multiple shot selective fire perforating gun for piercing oil field tubular goods, typically during the process of completing an oil or gas well. The perforating gun includes a multiplicity of shaped charges which are fired individually by an associated blasting cap and switch. The switch of all but the lowermost shaped charge is configured to disarm its associated blasting cap until the next lower shaped charge has detonated. The generation of the pressure pulse from detonation of the next lower shaped charge causes a piston in the switch to move to express a stream of flowable material onto a switch actuator which manipulates the switch to place it in an armed condition ready to fire.

19 Claims, 8 Drawing Figures

SELECTIVE FIRE PERFORATING GUN SWITCH

This application is a continuation-in-part of application Ser. No. 745,686, filed Nov. 29, 1976, now U.S. Pat. No. 4,100,978 which is a division of application Ser. No. 535,355, filed Dec. 23, 1974, now U.S. Pat. No. 4,007,796.

The art of perforating oil field tubular goods is rather well developed. The two basic types of perforating guns are the bullet and shaped charge. In bullet type perforators, a metal bullet is fired through the casing, through the cement sheath surrounding the casing and into the formation adjacent thereto. In a shaped charge type gun, the shaped charge burns a hole in the casing, in the cement sheath and partially into the formation therearound. Although both type guns have their advantages, the shaped charge type is at present somewhat more common. This invention is usable with either type gun and is designed to selectively fire one perforating element or a small group of elements out of a plurality of elements on the gun.

There are a number of different techniques for selectively firing perforating elements on a perforating gun containing additional perforating elements. The simplest type is often called a "two gun tandem" in which approximately half of the perforating elements are connected to a source of D.C. voltage through a diode of one polarity and the remaining perforating elements are connected to the source of D.C. voltage through a diode of opposite polarity. Applying a firing current of one polarity to the gun fires the first group of perforating elements while the second group is fired upon applying firing current of opposite polarity thereto. Although this technique is extremely simple, it lacks flexibility since one cannot, for example, assemble a series of eighty perforating elements and selectively fire only a few at a time.

In many petroleum producing areas of the world, producing formations of substantial thickness are encountered in which relatively thin streaks thereof contain sufficient hydrocarbon saturation and exhibit sufficient permeability to warrant completing. It is present practice to selectively perforate only those streaks or sections which exhibit both hydrocarbon saturation and permeability. Since such streaks may be numerous but thin and separated from each other by unproductive sections, it is desirable to provide a perforating gun which may carry a large number of perforating elements which may be selectively fired in very small groups.

In response to this need, multiple wire—multiple shot perforating guns were devised. In these devices, a plurality of separate circuits are employed to fire a like plurality of small groups of perforating elements. Although this type device works reasonably well, there are understandable complexities involved in providing a large number of circuits in guns which may be no more than about 1½" in diameter. In particular, it is somewhat difficult to seal all of the wiring against liquid leakage. Since many blasting caps have a safety feature whereby they refuse to fire if wet, it will be apparent that numerous problems can attend the manufacture and use of multiple wire—multiple shot perforating guns.

In response to these difficulties, there has been developed a single wire-multiple shot gun. In devices of this type, there are provided a plurality of spaced normally disarmed blasting cap-perforating element assemblages and an armed assemblage. When the armed assemblage is fired, the adjacent blasting cap-perforating element assemblage is armed through the use of a mechanically operated switch. It is this type of selective firing perforating gun that this invention most nearly relates. There are several disadvantages of the prior art single wire-multiple shot guns. First, the initiator or blasting cap is connected through a diode to a hot wire carrying a D.C. firing voltage. A switch breaks the circuit leading through the diode and blasting cap and is used to connect contacts of a bypass circuit around the blasting cap. Accordingly, when firing current is imposed on the bypass, firing current is presented to the blasting cap which is presumably disarmed through an open circuit. If the blasting cap is inadvertantly grounded or if the diode is inadvertantly grounded, inadvertant firing of the blasting cap and its associated perforating element occurs. This can be a very serious event. If the inadvertant shot occurs above ground, obvious injury to personnel and damage to equipment may occur. If the inadvertant shot occurs below ground, it must be squeezed off since the well may make significant quantities of water. If everything goes well, only a few thousand dollars may repair the inadvertant shot. If events proceed from bad to worse, in accordance with Murphy's law, a great deal of money may be spent in repairing the inadvertant shot.

As disclosed in substantial detail in the above mentioned applications, there has been developed a selective fire perforating gun and switch which acts, in the disarmed configuration, to short circuit the leads from the blasting cap and to isolate the blasting cap leads from any energized or grounded electrical wires. Devices of this type have considerable advantages in avoiding inadvertant firing of a blasting cap and its associated shaped charge. As will be more fully apparent hereinafter, one of the main goals of this invention is to provide a highly simplified and inexpensive switch which will disarm the blasting cap and its associated shaped charge and be capable of manipulating the switch in a simple, expeditious and fool proof manner to an armed position in response to a pressure pulse generated by the firing of the next lower perforating element.

In summary, this invention comprises a select fire perforating gun incorporating a multiplicity of initiator-perforating element assemblages which include a switch unit maintaining the assemblage in a disarmed configuration until the next lower assemblage is fired at which time the swithch unit is manipulated to arm the assemblage.

The switch unit comprises a housing or body which is temporarily captivated in the perforating gun and includes a piston exposed to a pressure pulse generated during the firing of the next lower assemblage. The piston acts on a partially confined body of liquifiable or flowable material which is extruded or expressed upon firing of the next lower assemblage. The expressed material is directed toward a switch actuator which moves from a disarmed position to an armed position in response to the flowable material impacting the switch actuator. In order to prevent rebound of the switch actuator from the armed position back to the disarmed position, a catch is provided for holding the switch actuator in the armed position.

It is accordingly an object of this invention to provide an improved technique for arming explosively actuated well tools.

Another object of this invention is to provide an improved perforating gun and switch therefor.

Other objects and a fuller understanding of the invention may be had by reference to the following description taken in conjunction with the accompanying drawings and claims.

IN THE DRAWINGS

DESCRIPTION OF THE PREFERRED EMBODIMENTS

Figure 1:
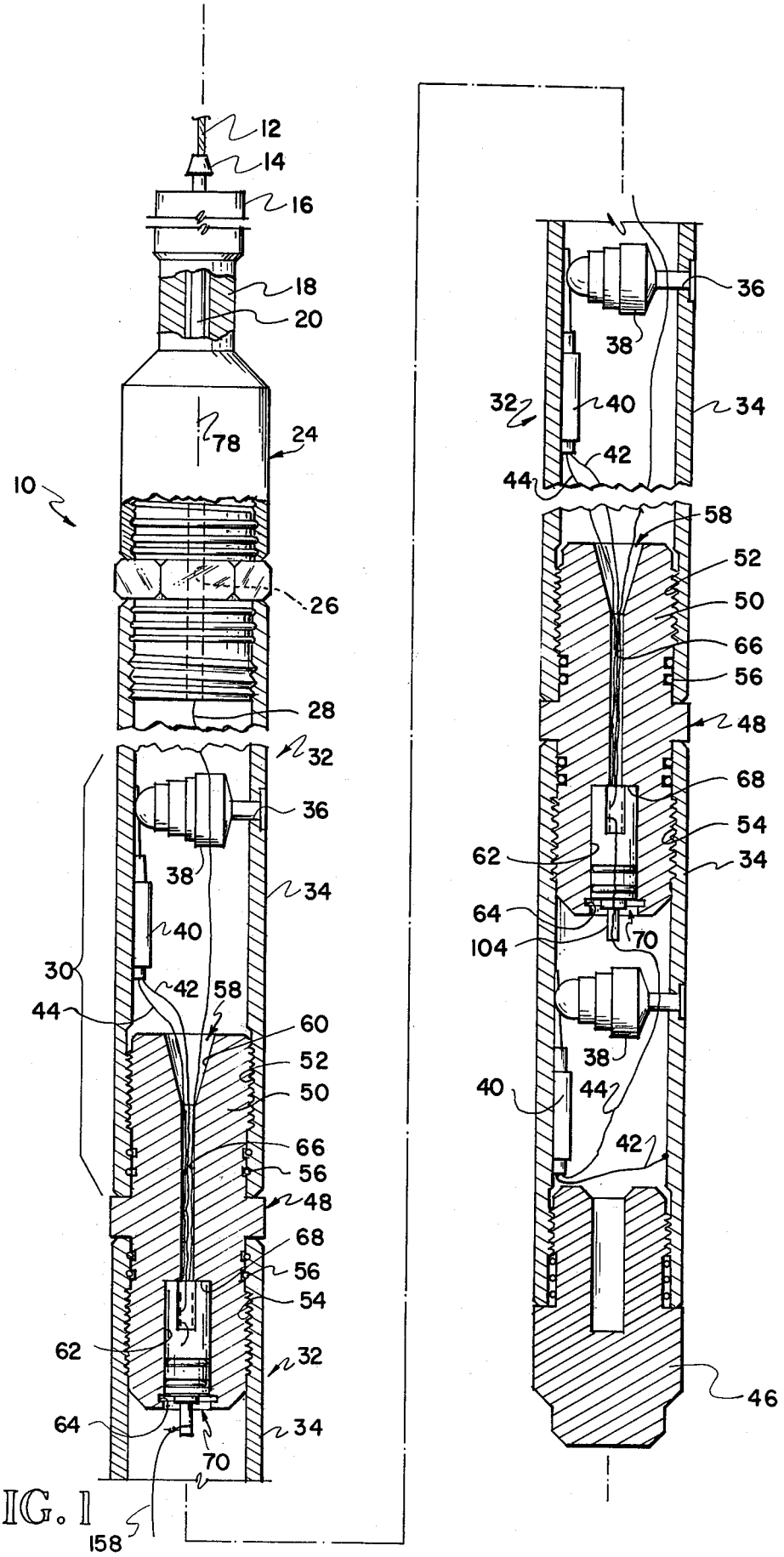
FIG. 1 is a side view of a perforating gun of this invention, certain parts being broken away for clarity of illustration.

Referring to FIG. 1, there is illustrated a perforating gun 10 which is raised and lowered in a well by manipulation of a suitable cable 12 having a central conductive wire, an external conductive sheath and an insulating sheath between the internal and external conductors designed to carry electrical current to various electrical devices in the gun 10. The cable 12 is connected to a suitable rope socket 14 which is conveniently screwed into the top of a conventional collar locator 16. As will be apparent to those skilled in the art, the collar locator 16 is designed to sense a collar or joint between adjacent pipe sections in order to properly position the tool 10. The collar locator 16 is attached to a firing head assembly 18.

The firing head assembly head 18 may be of conventional design and provides an internal insulated electrical path 20 which is connected through the collar locator 16 and the cable 12 to a D.C. source at the surface. The path 20 is accordingly part of a firing circuit 22 leading to the perforating elements to be described hereinafter. The firing head assembly 18 is attached onto the top of a sub 24 and provides a passage 26 for a hot wire 28.

Below the sub 24 are a plurality of repeating gun sections 30 each comprising an initiator-perforating element assemblage 32. The gun sections 30 and the assemblages 32 are substantially identical and comprise an internally threaded casing 34 having one or more ports 36 therein for receiving the discharge end of a perforating element 38 which is illustrated as being of the shaped charge variety. An initiator or blasting cap 40 is disposed adjacent the shaped charge 38 for detonating the same in a conventional manner. The blasting cap 40 is provided with first and second wires or leads 42, 44 for purposes more fully explained hereinafter.

The lowermost assemblage 32 is conveniently armed in any suitable manner, as by grounding the blasting cap wire 42 to the casing 34 and connecting the other blasting cap wire 44 to the firing circuit 22. In the alternative, the lowermost assemblage 32 may initially be disarmed and provided with a mechanism for arming the same, e.g. means for sensing hydrostatic pressure in the borehole outside the gun 10 for arming the assemblage when an appropriate borehole depth is reached. The lower end of the lowermost assemblage 32 is closed in any suitable manner, as by the provision of a bull plug 46 as illustrated in FIG. 1.

The general plan of operation of this invention and of the prior art single wire-multiple shot perforating guns is that the hot wire side of the firing circuit includes a switch for each initiator-perforating element assemblage which completes a bypass circuit to the next lower assemblage while disarming its associated assemblage. Upon firing of the lowermost assemblage, the switch of the next upper assemblage is manipulated to arm its associated blasting cap initiator. Firing of the shots carried by the gun 10 then proceeds from the bottom of the gun toward the top thereof. As heretofore illustrated and described, the perforating gun 10 is of substantially conventional design and may be obtained commercially from Gearhart-Owen Industries, Inc. of Ft. Worth, Texas.

A switch sub 48 is connected between adjacent assemblages 32 and comprises a rigid body 50 suitably of machined metal or the like having upper and lower external threads 52, 54 for coupling with the adjacent gun sections 30. Suitable O-rings 56 seal between the body 50 and the adjacent gun sections 30 to prevent liquid passage into the gun 10. An elongate passage 58 extends axially through the switch sub 48 and comprises an upper conical section 60, a lower cylindrical section 62 having a snap ring groove 64 therein, and an intermediate section 66 communicating between the upper and lower sections 60, 62. The junction between the sections 62, 66 provides an annular shoulder 68 for purposes more fully explained hereinafter. As will be more fully apparent hereinafter, the switch mechanism of this invention is mounted in the passage section 62.

Figure 2:
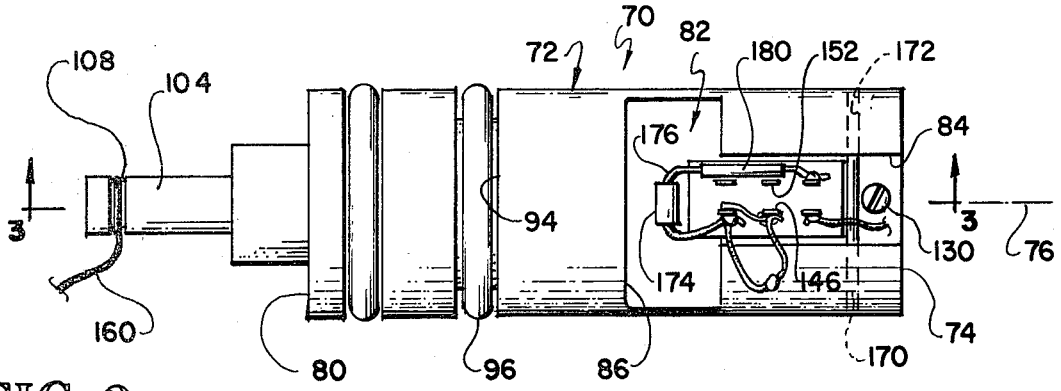
FIG. 2 is a side view of the switch assembly utilized in the perforating gun of FIG. 1 illustrating the disarmed configuration.
Figure 3:
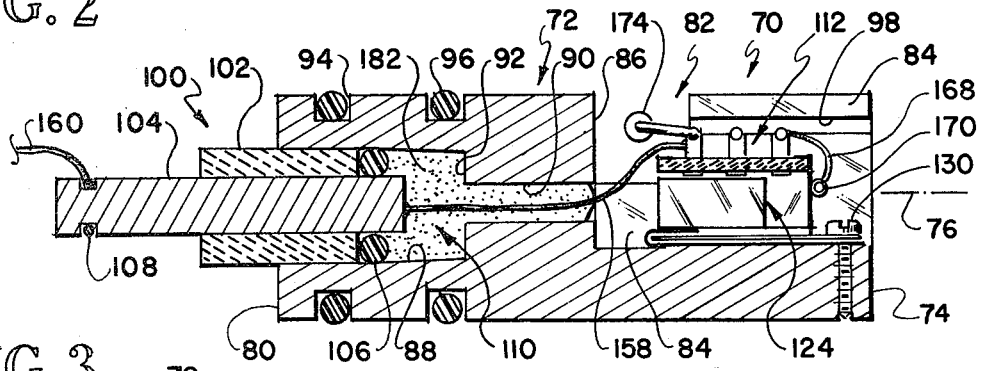
FIG. 3 is a longitudinal cross-sectional view of the switch of FIG. 2 taken substantially along line 3—3 thereof as viewed in the direction indicated by the arrows.

Referring to FIGS. 2 and 3, there is illustrated a switch unit 70 of this invention. The switch unit 70 provides a multiplicity of functions during operation of the perforating gun 10 which may be broadly classified as disarming functions and arming functions. In the disarmed configuration of the switch unit 70, its associated blasting cap 40 is electrically separated from any contact with the firing circuit 22, an electrical bypass circuit is made through the switch unit 70 to provide a hot wire for a subjacent assemblage 32, and the terminals of its associated blasting cap 40 are short circuited. Responding to the detonation of a subjacent perforating element, the arming functions of the switch unit 70 are removing the short circuit between the blasting cap leads 42, 44, placing the blasting cap 40 in circuit with the hot wire 28 and severing the circuit leading to the subjacent fired assemblage.

One of the problems in designing a switch unit for a select fire perforating gun is that the pressure pulse generated during firing of a subjacent shaped charge is of considerable magnitude. Although the magnitude of the pressure pulse is unknown, it would not be surprising to learn that the pressure peak is in excess of 30,000 psi. Accordingly, one is faced with the dilemma of constructing an inexpensive extremely rugged switch mechanism. Another problem with a mechanical linkage for converting the pressure pulse into switch movement is that the linkage must be designed and assembled to very close tolerances so that the moveable switch member is moved precisely the correct distance. For example, if the switch member is moved against a stop and too much movement is attempted, some component will necessarily break or warp. As will become more fully apparent hereinafter, these problems are avoided by spacing the switch a considerable distance from any moving mechanical part and squirting a flowable material onto the moveable switch member in order to effect movement.

Figure 4:
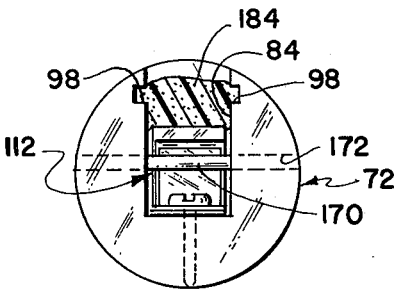
FIG. 4 is a top view of the switch body of FIGS. 2 and 3.

To these ends, the switch unit 70 comprises a rigid generally cylindrical body or housing 72 having a generally planar upper end or face 74 perpendicular to a longitudinal axis 76 of the body 72 which is coaxial with a longitudinal axis 78 of the perforating gun 10, a lower face or end 80 generally parallel to the upper face 74 and a generally T-shaped slot 82 comprising an axially extending leg 84 opening through the upper end 74 and a transverse leg 86. The body 72 also comprises an enlarged passage 88 which appears to be cylindrical but which is slightly divergent toward the lower end 80 for purposes more fully explained hereinafter. The passage 88 communicates with the T-shaped slot 82 through a passage 90 of reduced size when compared to the passage 88. The passages 88, 90 define a shoulder 92 at the junction thereof. The switch body 72 also comprises a plurality of circumferential grooves 94 for receiving a like plurality of O-rings 96 providing a pressure seal between the exterior of the switch body 72 and the passage section 62 in the switch sub 48. As shown best in FIG. 4, the switch body 72 also comprises a pair of opposed slots 98 opening into the leg 84.

Extending into the passage 88 and mounted for limited axial movement therein is a piston assembly 100 comprising a cylindrical sleeve 102 of electrical insulating material such as a phenolic resin, a central pin 104 of electrically conductive material such as metal or the like, and an O-ring seal 106 surrounding the pin 104 providing a seal between the pin 104 and passage 88 in the disarmed position and sealing against the shoulder 92 in the armed position. The pin 104 provides a circumferential groove 108 about the exposed end thereof to allow easy attachment of an electrical wire leading to the next subjacent assemblage 32. It will be apparent from FIG. 3 that the switch unit 70 provides a reservoir 110 which is decreased in size upon upward movement of the piston assembly 100 as more fully pointed out hereinafter.

Figure 7:
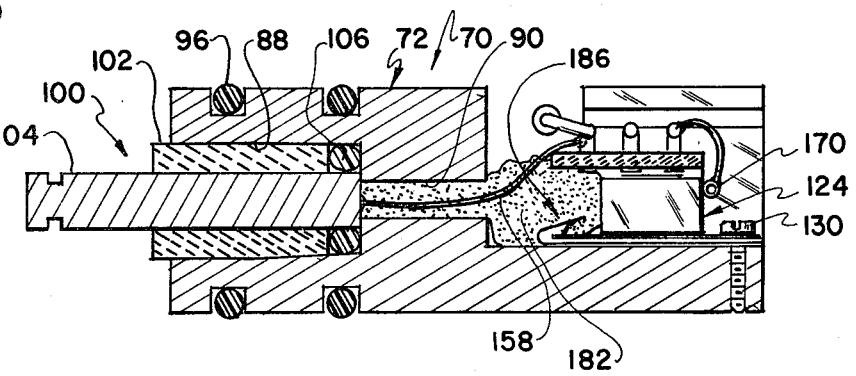
FIG. 7 is a cross-sectional view similar to FIG. 3 illustrating the switch assembly in the armed configuration.
Figure 5:
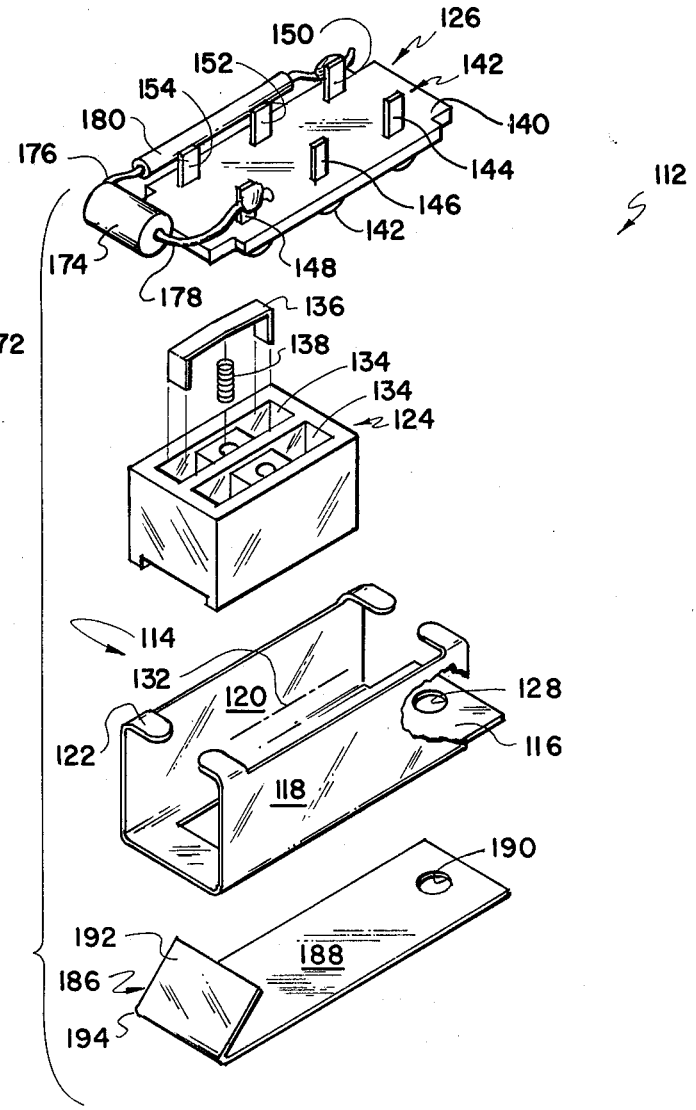
FIG. 5 is an exploded isometric view of the switch of FIGS. 2–6.

Mounted on the switch body 72 in the T-shaped slot 82 is a switch 112 best illustrated in FIGS. 3, 5 and 7. Although the switch 112 may be of any suitable type commensurate with its desired functions, it is preferred that the switch 112 be a mass produced, inexpensive switch having a multiplicity of switched terminals and providing a generally reciprocably mounted switch member of reasonable size. Although many different types of switches fit this description, one exemplary selection that has proved satisfactory is commercially available from Radio Shack as Model 275-407.

Referring to FIG. 5, the switch 112 is illustrated in substantial detail and comprises a metallic bracket 114 having a bottom wall 116, upstanding walls 118, 120, a plurality of tangs 122 for captivating a moveable carrier 124 and a stationary terminal holder 126. The bottom wall 116 provides an opening 128 therethrough for receiving a screw 130 for attaching the switch 112 to the switch body 72.

The carrier 124 is of generally rectilinear configuration and is of an electrically insulating material such as a phenolic resin or the like. THe carrier 124 is mounted between the vertical walls 118, 120 for movement in a generally linear path 132 and provides a pair of elongate parallel slots 134 each receiving a generally U-shaped switch element 136 biased by a spring 138 toward the terminal holder 126.

The terminal holder 126 includes a generally planar section 140 of electrically insulating material such as a phenolic resin. Extending through the planar section 140 are a multiplicity of switch terminals each of which includes a rounded end 142 below the section 140 for engagement with one or the other of the switch elements 136. The terminals also include an upstanding leg 144, 146, 148, 150, 152, 154 for connection to various electrical leads as will be more fully pointed out hereinafter.

With the carrier 124 in its lower position illustrated in FIG. 3, it will be seen that the legs 146, 148 and the legs 152, 154 are electrically connected by the switch elements 136. When the carrier 124 moves to its upper position illustrated in FIG. 7, the legs 144, 146 and the legs 150, 152 are electrically connected by the switch elements 136.

Figure 6:
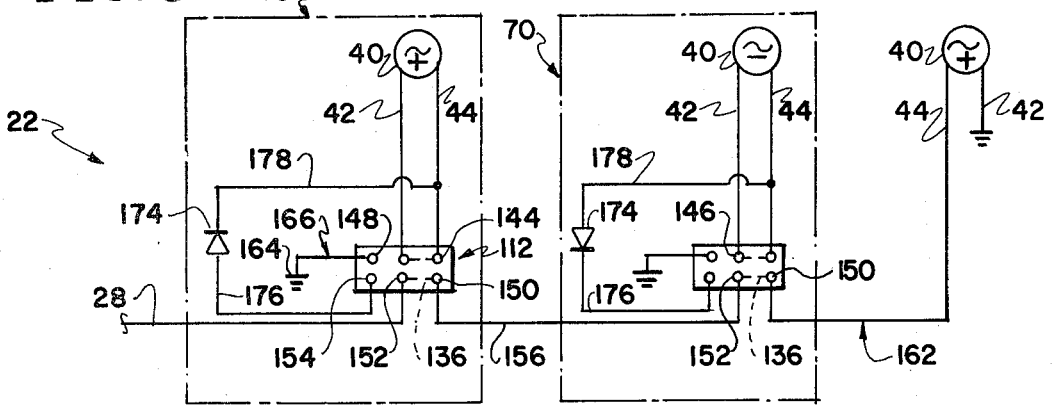
FIG. 6 is a schematic diagram of the electrical circuit through a pair of the switch assembles of FIGS. 1 and 2 illustrated in the unarmed configuration.
Figure 8:
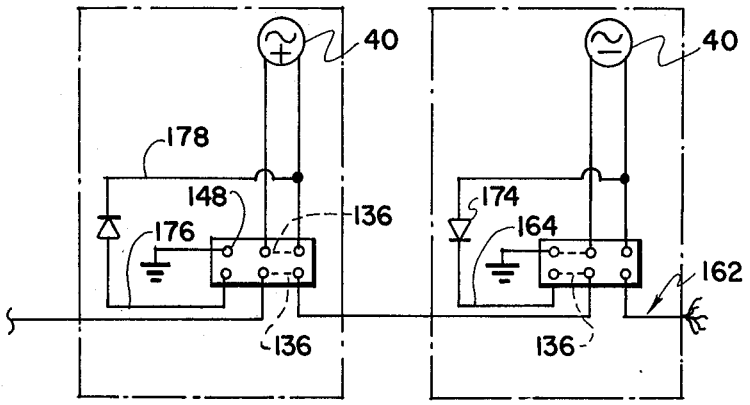
FIG. 8 is a schematic view similar to FIG. 6 illustrating the condition when the lowermost perforating charge has been detonated and the next lower switch assembly has been armed.

Referring to FIGS. 1–3 and 6, the arrangement of the firing circuit 22 and particularly the wiring of the switch units 70 is illustrated. For purposes of simplicity, the showings of FIGS. 1, 6 and 8 are described hereinafter as including three blasting caps 40 although it should be understood that as many gun sections 30 may be provided as desired. The hot wire 28 is illustrated in FIG. 1 as extending through the passage 58 to the switch 112 of the upper switch unit 70.

As shown in FIG. 6, the hot wire 28 is connected to the terminal leg 152 of the upper switch 112. An electrical connection 156 extends from the terminal leg 150 of the upper switch unit 70 to the terminal leg 152 of the lower switch unit 70. As shown best in FIG. 3, the electrical connection 156 includes an insulated wire 158 connected between the terminal leg 150 and the conductive pin 104 and a second insulated wire 160 having a bared end tied about the groove 108 and extending through the passage 58 of the subject switch sub 48 to connect to the terminal leg 152 of the lower switch unit 70. Providing an electrical path between the terminal leg 150 of the lower switch unit 70 and the lowermost blasting cap 40 is an electrical connection 162 comprising a wire connecting the terminal leg 150 to the pin 104 which is in turn connected to the blasting cap lead 44 as shown in FIG. 1. Because the switch elements 136 are in the lower position, an electrical path is completed from the hot wire 28 to the lead 44 of the lowermost blasting cap 40. Accordingly, the lowermost blasting cap 40 is armed and ready to fire.

The terminal legs 144, 146 of the switch units 70 are connected to the legs 42, 44 of the blasting caps 40 associated with the switch units 70. Because the switch elements 136 are in the lower position, it will be seen that the leads 42, 44 of the blasting caps 40 associated with the switch units 70 are short circuited. It will also be evident that the leads 42, 44 are wholly isolated from any component of the firing circuitry 22 which is energized or grounded during firing of a subjacent blasting cap.

The terminal legs 148 of the switch units 70 are connected to a ground 164 by an electrical connection 166 as shown in FIGS. 6 and 8. The electrical connection 166 comprises, as shown in FIG. 3, a lead 168 connected between the leg 148 and a roll pin 170 press fit in an aperture 172 provided by the switch body 72. Because the switch body 72 is in electrical communication with the switch sub 48 and consequently the gun housings 34 which is electrically connected to the external conductive sheath of the cable 12, it will be evident that the terminal leg 148 is grounded.

As shown schematically in FIGS. 6 and 8, the switch units 70 comprise oppositely facing diodes 174 connected by leads 176, 178 to the terminal legs 154, 144 respectively. As shown in FIGS. 2 and 5, an insulating sleeve 180 surrounds the bare lead 176 along a path adjacent the terminal legs 150, 152 to prevent inadvertant shorting of the circuitry in the switch units 70.

The reservoir 110 is filled with a flowable material 182 which is squirted toward the carrier 122 to effect movement thereof as shown by a comparison of FIGS. 3 and 7. The material 182 may be a solid or semi-solid at atmospheric temperatures and pressure and have the capability of flowing, i.e. being expressed or extruded, at normal temperatures existing in well bores where the gun 10 is to be used. Because well-bore temperatures vary quite widely, in the range of about 100°–500° F., it is desirable that any phase change of the material occur at a substantially higher temperatures. Although it is conceivable that the material 182 may be electrically conductive provided that the terminal legs be covered with an insulating potting material as disclosed hereinafter and provided that the leads to the terminal legs be well insulated, it is highly preferred that the material 182 be electrically insulating. Although a number of compositions fit this description, a silicone grease, such as is available from General Electric Company, has proved satisfactory.

The reservoir 110 and preferably the passage 90 are substantially filled with the grease during assembly of the unit 70, as by the use of a syringe. As will be more fully apparent hereinafter, the passage 90 may be partially filled, exactly filled or over filled without effecting the operation of the switch unit 70.

Although the switch 112 is connected to the switch body 72 by the screw 130, it is desirable to further secure and stabilize the switch 112 for several reasons. First, the impact of the flowable material 182 onto the carrier 124 and the remainder of the switch 112 can be significant. To illustrate the magnitude of the forces acting on the switch unit 70, realizing that the showings of FIGS. 2 and 3 are about twice full scale, initial testing was performed by clamping the switch body 72 in a vise and smartly striking the pin 104 with a sledge hammer. Second, any bending of the switch bracket 114 can have serious repercussions because of the likelihood that one or more of the leads connected to the terminal legs will be shorted against the switch body 72. In order to further stabilize the switch 112, a potting material 184 is placed on the exposed side of the planar section 140 to cover the exposed terminal legs and extends into the grooves 98. Although the potting material 182 may be of any desired type, it is preferred to use a quick setting epoxy resin adhesive. It will accordingly be apparent that the potting material sets up in a hard tough body captivating the switch 112 in place.

When the switch units 70 are assembled, an anti-rebound mechanism 186 is installed to prevent the carrier 124 from rebounding off of the roll pin 170, which acts as a stop or limit of upward movement of the carrier 124. The mechanism 186 comprises a base 188 having an opening 190 therein. The base 188 is positioned below the switch bracket 114 and the screw 130 extends through the opening 190 to captivate the mechanism 186 in place. The mechanism 186 also includes a catch 192 comprising an angled or reverted end of the base 188. In the unarmed position of the switch unit 70 shown in FIG. 3, the catch 192 is positioned between the bottom of the carrier 124 and the bracket 114. The catch 192 is upwardly biased by the properties of the material in the bend 194 between the catch 192 and the base 188. Accordingly, when the carrier 124 is driven by the flowable material 182, the carrier 124 moves beyond the free end of the catch 192 whereupon the catch 192 angularly moves to a position to engage the carrier 124 in the event it should tend to rebound as suggested in FIG. 7.

Assembly of the switch unit 70 in the switch sub 48 is accomplished by placing the switch body 72 in the passage section 62 and placing a snap ring (not shown) in the groove 64.

In operation, the firing circuit 22 is configured as shown in FIG. 6 while the perforating gun 10 is being run into the hole. When the lowermost shaped charge 38 is appropriately positioned, a positive D.C. voltage is delivered through the hot wire 28 and the electrical connections 156, 162 to detonate the lowermost blasting cap 40 and ignite its associated shaped charge 38. The temperature generated by the ignition of the lowermost shaped charge 38 vaporizes or melts the lowermost leads 42, 44. The pressure generated by the ignition of the lowermost shaped charge 38 drives the piston assembly 100 of the lower switch unit 70 upwardly and expresses or extrudes the flowable silicon grease 182 toward the switch carrier 124 and drives it upwardly against the limit provided by the roll pin 170 as suggested by a comparison of FIGS. 3 and 7. Upward movement of the carrier 124 causes the switch elements 136 to sever the electrical connection between the terminal legs 144, 146 and between the terminal legs 150, 152 and to make an electrical connection between the terminal legs 146, 148 and between the terminal legs 152, 154. Accordingly, the electrical configuration of the gun 10 is changed from the configuration shown in FIG. 6 to the configuration shown in FIG. 8. In this fashion, the lower switch unit 70 is changed from the unarmed configuration shown in FIG. 6 to an armed configuration shown in FIG. 8. Accordingly, the blasting cap 40 associated with the lower switch unit 70 is armed and can be fired by the application of a negative D.C. voltage to the hot wire 28.

In a similar manner, firing of the blasting cap 40 and shaped charge 38 is associated with the lower switch unit 70 acts to arm the upper switch unit 70 which can then be fired by the application of a positive D.C. voltage to a hot wire 28. It will be evident to those skilled in the art that the orientation of the diodes 174 dictates what polarity of D.C. voltage will fire the blasting cap associated therewith. For example, the application of positive D.C. voltage to the lower switch 70 will not fire the blasting cap 40 associated therewith because the diode 174 is arranged not to pass positive D.C. voltage.

If often happens that the O-ring seals associated with a particular gun section 32 will leak thereby allowing mud or other completion liquid to enter the housing 34 and pressurize it to the hydrostatic pressure existing in the well at the depth of the gun 10. Absent any special provisions, the switch unit 70 exposed to the hydrostatic pressure will not arm. In one sense, it is desirable for the silicon grease to dribble out rather than squirt out in response to hydrostatic pressure because the switch carrier 122 is not moved by dribbles of silicon grease but rather by a forceable squirt thereof. Accordingly, it is evident that a false arming of any particular switch because of exposure to hydrostatic pressure is avoided. In another sense, upward creeping of the piston assembly 100 in response to hydrostatic pressure is undesirable because any switch unit 70 exposed to hydrostatic pressure will thereafter be incapable of arming. This, of course, requires that the gun 10 be removed from the well and the unarmable switch unit 70 replaced. Accordingly, the relationship between the passage 88 and the piston assembly 100 is selected to avoid creep of the piston assembly 100 in response to hydrostatic pressure. Instead of a close cylindrical-to-cylindrical fit as might be expected, it is preferred that the piston assembly 100 and the passage 88 have a progressively increasing interference fit. A convenient technique for accomplishing the interference fit is for the sleeve 102 to be cylindrical and the passage 88 to be frustoconical and downwardly diverging. The amount of divergence of the passage 88 is desirably small, i.e. less than about 10° and is preferably on the order of about 2°. In the alternative, the lower end of the passage 88 may be cylindrical for readily receiving the sleeve 102 and the upper end may be frustoconical and downwardly diverging.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed.

I claim:

1. A switch comprising:

a plurality of contacts, means mounting the contacts for relative movement, and a member effecting relative movement of the contacts upon application of an impact force thereto; and means for applying a contact moving impact force to the member including a receptacle having therein a body of flowable material spaced from the member and means for generating an unconfined stream of material from the receptacle and for directing the same against the member including means for applying pressure to the material.

2. The switch of claim 1 wherein the flowable material is a semi-solid at temperatures of less than about 500° F. and is flowable in response to the application of pressure.

3. The switch of claim 2 wherein the flowable material is a grease.

4. The switch of claim 2 wherein the flowable material is non-conductive.

5. The switch of claim 4 wherein the flowable material is a silicon grease.

6. The switch of claim 1 wherein the mounting means comprises a stationary bracket carrying at least two of the plurality of contacts, and at least one of the plurality of contacts being carried by the member.

7. The switch of claim 6 comprising more than two of the plurality of contacts on the bracket and a plurality of contacts on the member.

8. A switch of claim 6 further comprising a housing carrying the stationary bracket and the member, and wherein the directing means includes a passage in the housing communicating at one end with the receptacle and facing at the other end toward the member.

9. The switch of claim 8 wherein the receptacle is closed except for the directing passage.

10. The switch of claim 8 wherein the receptacle opens through the exterior of the housing and wherein the pressure applying means includes means closing the receptacle opening and movable toward the housing interior for decreasing the volume of the receptacle.

11. The switch of claim 10 wherein the means closing the receptacle opening comprises a piston mounted in the receptacle for substantially linear movement.

12. The switch of claim 11 wherein the relation between the piston and the receptacle is of a progressively increasing interference fit during movement of the piston.

13. The switch of claim 6 wherein the member is mounted for movement from a first position to a second position and further comprising means operative adjacent the second position for preventing rebound of the member from the second position.

14. The switch of claim 13 wherein the rebound preventing means includes an element engaging the member at the second position and precluding movement thereof toward the first position.

15. The switch of claim 1 further comprising a housing incorporating the generating means and wherein the pressure applying means includes means responsive to a force applied to the housing for applying pressure to the material.

16. The switch of claim 1 wherein the directing means includes means for directing a pressure squirt of the material toward the mounting means.

17. The switch of claim 16 wherein the member is above the directing means.

18. A switch unit comprising:

a switch having a plurality of stationary contacts and a member mounted for movement in a switching path carrying a plurality of contacts; and a switch body mounting the switch and including means for applying an impact force to the member, comprising a receptacle having therein a body of flowable material spaced from the member, means for generating an unconfined stream of the flowable material from the receptacle and for directing the same against the movable member including means for applying pressure to the material in response to a force applied to the switch body.

19. The switch unit of claim 18 further comprising a first securement means for connecting the switch to the body and a second securement means comprising potting material bonding the switch to the body out of a path of movement of the flowable material.

* * * * *

UNITED STATES PATENT OFFICE

CERTIFICATE OF CORRECTION

PATENT NO. : 4,234,768

DATED : November 18, 1980

INVENTOR(S) : Gene T. Boop

It is certified that error appears in the above-identified patent and that said Letters Patent are hereby corrected as shown below:

| | |
|---|---|
| Title page, left column, line 4 | delete "[73] Assignee: Sie, Inc., Ft. Worth, Texas"; |
| Column 4, line 35 | delete "to"; and |
| Column 6, line 7 | change "THe" to --The--. |

Signed and Sealed this

*Seventh* Day of *September 1982*

[SEAL]

*Attest:*

GERALD J. MOSSINGHOFF

*Attesting Officer*

*Commissioner of Patents and Trademarks*